US006190120B1

(12) United States Patent
Thatcher et al.

(10) Patent No.: US 6,190,120 B1
(45) Date of Patent: Feb. 20, 2001

(54) PARTIALLY TURBULATED TRAILING EDGE COOLING PASSAGES FOR GAS TURBINE NOZZLES

(75) Inventors: Jonathan Carl Thatcher; Steven Sebastian Burdgick, both of Schenectady, NY (US)

(73) Assignee: General Electric Co., Schenectady, NY (US)

( * ) Notice: Under 35 U.S.C. 154(b), the term of this patent shall be extended for 0 days.

(21) Appl. No.: 09/312,427

(22) Filed: May 14, 1999

(51) Int. Cl.[7] ..... F01D 5/18
(52) U.S. Cl. ..... 415/115; 415/178; 416/97 R
(58) Field of Search ..... 415/115, 116, 415/176, 177, 178, 191; 416/95, 96 A, 96 R, 97 R

(56) References Cited

U.S. PATENT DOCUMENTS 3,528,751 * 9/1970 Quinones et al. ..... 416/97 R
5,931,638 * 8/1999 Krause et al. ..... 416/97 R
6,004,100 * 12/1999 Przirembel et al. ..... 416/97 R

* cited by examiner

*Primary Examiner*—Edward K. Look
*Assistant Examiner*—Liam McDowell
(74) *Attorney, Agent, or Firm*—Nixon & Vanderhye

(57) ABSTRACT

A plurality of passages are spaced one from the other along the length of a trailing edge of a nozzle vane in a gas turbine. The passages lie in communication with a cavity in the vane for flowing cooling air from the cavity through the passages through the tip of the trailing edge into the hot gas path. Each passage is partially turbulated and includes ribs in an aft portion thereof to provide enhanced cooling effects adjacent the tip of the trailing edge. The major portions of the passages are smooth bore. By this arrangement, reduced temperature gradients across the trailing edge metal are provided. Additionally, the inlets to each of the passages have a restriction whereby a reduced magnitude of compressor bleed discharge air is utilized for trailing edge cooling purposes.

7 Claims, 3 Drawing Sheets

PARTIALLY TURBULATED TRAILING EDGE COOLING PASSAGES FOR GAS TURBINE NOZZLES

This invention was made with Government support under Contract No. DE-FC21-95MC31176 awarded by the Department of Energy. The Government has certain rights in this invention.

TECHNICAL FIELD

The present invention relates to gas turbine nozzles having cooling passages for flowing a thermal medium from a cavity within the nozzle vane through the passages into the hot gas path for cooling the trailing edge and particularly relates to trailing edge cooling passages having turbulators and cooling passage inlets arranged to enhance temperature distribution, minimize thermal stresses and trailing edge cracks and reduce the magnitude of required bleed air.

BACKGROUND OF THE INVENTION

Trailing edges of nozzle vanes in gas turbines often contain cooling passages for cooling the trailing edges. Typically, cooling air is provided in a cavity in the vane and passes through a plurality of passages spaced from one another along the length of the trailing edge of the vane and exits into the hot gas path. The cooling air cools the metal of the trailing edge surrounding the passages and along outer surfaces of the trailing edge. Conventionally, thermal barrier coatings are provided along the side walls of the trailing edge and about the trailing edge tip. However, notwithstanding efforts to uniformly apply the thermal barrier coating to the side walls and tip of the trailing edge, the coating oftentimes breaks off from the tip during handling or spalls off the tip during operation. Thus, cooling the tip of the trailing edge is of particular concern and therefore requires heat transfer enhancement for effective cooling.

Turbulators have also been employed in the passages for cooling the trailing edges of nozzles. The turbulators interrupt the cooling air flow, creating turbulence and cause enhanced cooling effect. Turbulators are conventionally located along the entire length of the cooling passages. This therefore results in enhanced cooling of the surrounding metal and trailing edge surfaces throughout the length of the trailing edge passages. The material of these regions, however, are protected, to a large extent, by the thermal barrier coating along the sides of the trailing edge. Consequently, the region requiring cooling enhancement, i.e., the tip of the trailing edge, is effectively cooled, while those regions which are protected by the thermal barrier coating and do not require cooling enhancement are nonetheless provided with enhanced cooling effects by the turbulators. This causes a wide-ranging temperature distribution laterally along the trailing edge, with consequent thermal mismatches resulting in high stresses in the metal of the trailing edge.

Further, it will be appreciated that air for cooling the trailing edge of nozzle vanes typically comprises compressor discharge air. To the extent air is bled from the compressor for cooling purposes, the turbine has diminished efficiency. Accordingly, the problem at hand is to provide enhanced cooling effect in the regions requiring enhanced cooling, while eliminating enhanced cooling for those regions of the trailing edge which do not require enhanced cooling, while simultaneously limiting required cooling bleed air from the compressor discharge.

BRIEF SUMMARY OF THE INVENTION

In accordance with the present invention, there is provided a gas turbine nozzle vane having trailing edge cooling passages for receiving a thermal medium, preferably air, for cooling the trailing edge and which vane employs partially-turbulated trailing edge cooling passages. By providing cooling air passages only partially turbulated, a temperature distribution across the trailing edge is achieved with minimized thermal gradients and consequent reduced stresses, while affording enhanced cooling along the tip of the trailing edge with minimal compressor bleed discharge air. To accomplish the foregoing, a nozzle vane trailing edge is provided having a plurality of cooling passages spaced one from the other along the length of the trailing edge and lying in communication with a cavity within the vane. Cooling air flows from the cavity through the cooling passages into the hot gas stream. The passages, however, are only partially turbulated and then only in regions where enhanced heat transfer is required. Thus, the aft portions of the trailing edge passages adjacent the tip, i.e., adjacent the outlet of the cooling air flowing into the hot gas stream, are turbulated, while the majority of the passages forwardly of the turbulated passage portions are not turbulated. Preferably, those forward passage portions have smooth bores. Consequently, the temperature distribution in the metal regions surrounding the non-turbulated passage portions minimizes the thermal gradients and reduces stresses, while the turbulated aft passage portions afford enhanced cooling effects in the region along the trailing edge tip where the thermal barrier coating has worn or spalled off during operation.

Further, bleed compressor discharge air is minimized for flow through the cooling passages by limiting the size of the entry slots into the passages. Thus, each entry slot adjacent the forward end of the passages has a reduced cross-section, limiting the air flow into the passage. In this manner, reduced compressor bleed discharge air is required thereby affording improved turbine efficiency.

In a preferred embodiment according to the present invention, there is provided cooling apparatus for a turbine comprising a turbine vane having a trailing edge terminating in an aft tip and a cavity forward of the trailing edge for receiving a thermal medium, the trailing edge including a plurality of discrete passages spaced one from another along the length of the trailing edge, the passages lying in communication at one end with the cavity for receiving the thermal medium from the cavity for flow therethrough to apertures along the tip of the trailing edge and turbulators disposed in the passages along aft portions thereof with portions of the passages forwardly of the aft portions and forming the majority of the lengths of the passages being without turbulators, each turbulator forming an abutment surface in the aft passage portion for creating turbulence in the thermal medium passing through the aft passage portions thereby cooling the trailing edge and minimizing thermal gradients and stresses therealong.

In a further preferred embodiment according to the present invention, there is provided cooling apparatus for a turbine comprising a turbine vane having a trailing edge terminating in an aft tip and a cavity forward of the trailing edge for receiving a thermal medium, the trailing edge including a plurality of discrete passages spaced one from another along the length of the trailing edge, the passages lying in communication at one end with the cavity for receiving the thermal medium from the cavity for flow therethrough to apertures along the tip of the trailing edge and turbulators disposed in the passages forming abutment surfaces for creating turbulence in the thermal medium passing through the passage portions thereby cooling the trailing edge and forward portions of the passages having reduced flow inlet apertures adjacent junctions of the cavity and passages for limiting the flow of thermal medium into the passages.

DETAILED DESCRIPTION OF THE INVENTION

Figure 1:
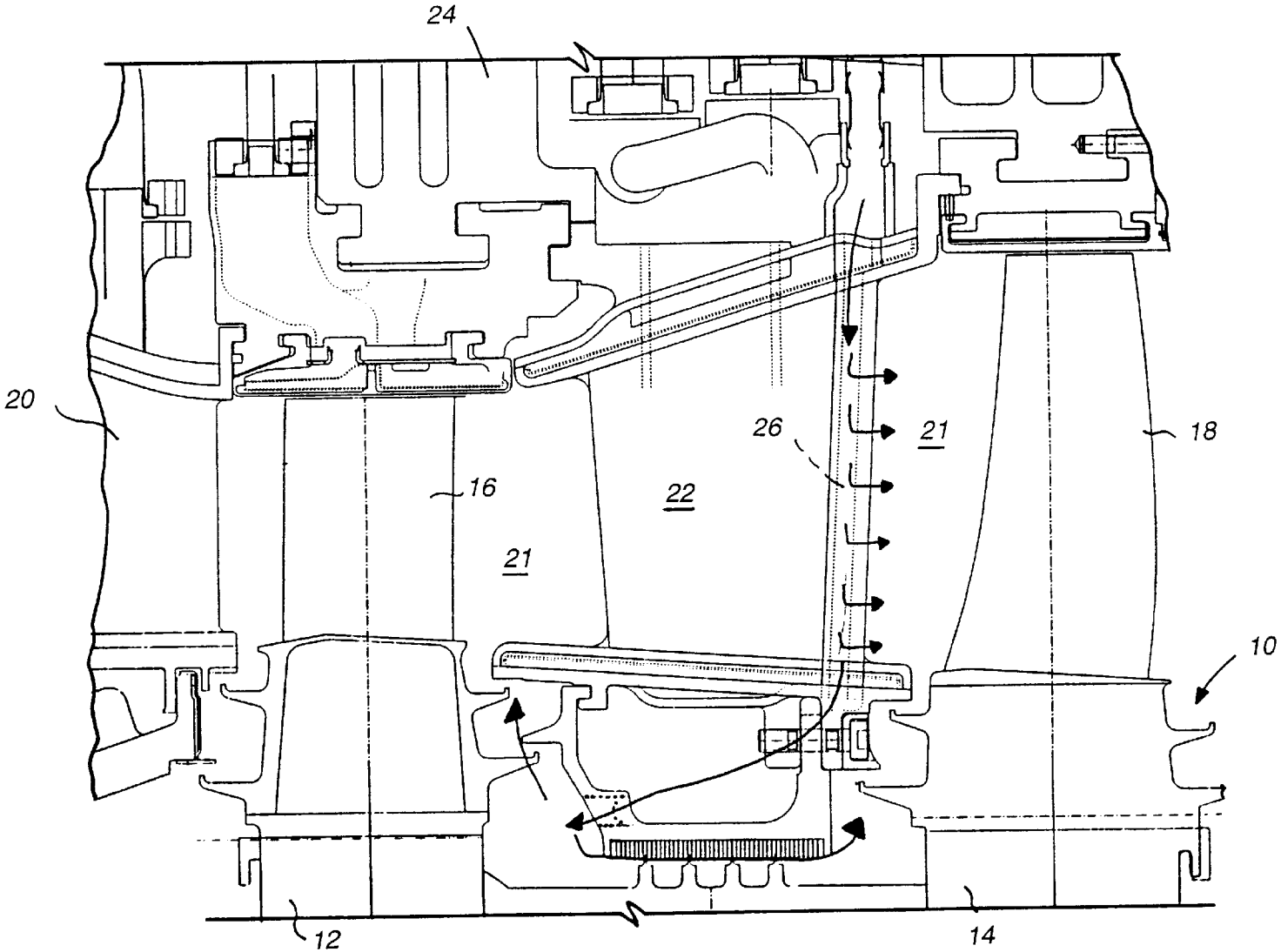
FIG. 1 is a fragmentary elevational view of a hot gas path of a turbine illustrating nozzle vanes and rotor buckets situate in the turbine, the rotor vane being illustrated with a trailing edge having cooling passages according to the present invention.

Referring to the drawings, particularly to FIG. 1, there is illustrated a portion of a rotor, generally designated 10, and particularly first and second wheels 12 and 14, respectively, of the rotor. Each of the wheels 12 and 14 carries a circumferential array of buckets 16 and 18, respectively. Circumferential arrays of first and second-stage nozzle vanes 20 and 22 are also illustrated. It will be appreciated that the buckets 16 and 18 and nozzle vanes 20 and 22 lie in the hot gas path 21 of the turbine. In the turbine illustrated in FIG. 1, the nozzle vane 22 is carried by an inner shell 24, the details of which form no part of the present invention. Suffice to say that nozzle vanes 22 lie in the hot gas path and the trailing edges of the nozzle vanes are air-cooled by flowing cooling air, typically from the compressor discharge, into a trailing edge cavity 26 for flow through passages through the trailing edge tip into the hot gas stream.

Figure 3:
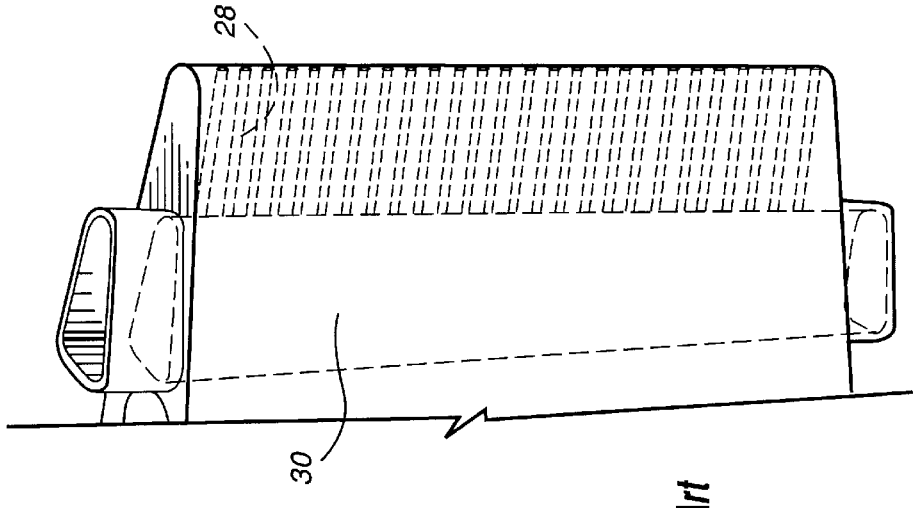
Fig. 3 Prior Art
FIG. 3 is a perspective view of a portion of the prior art turbulated flow passage.
Figure 2:
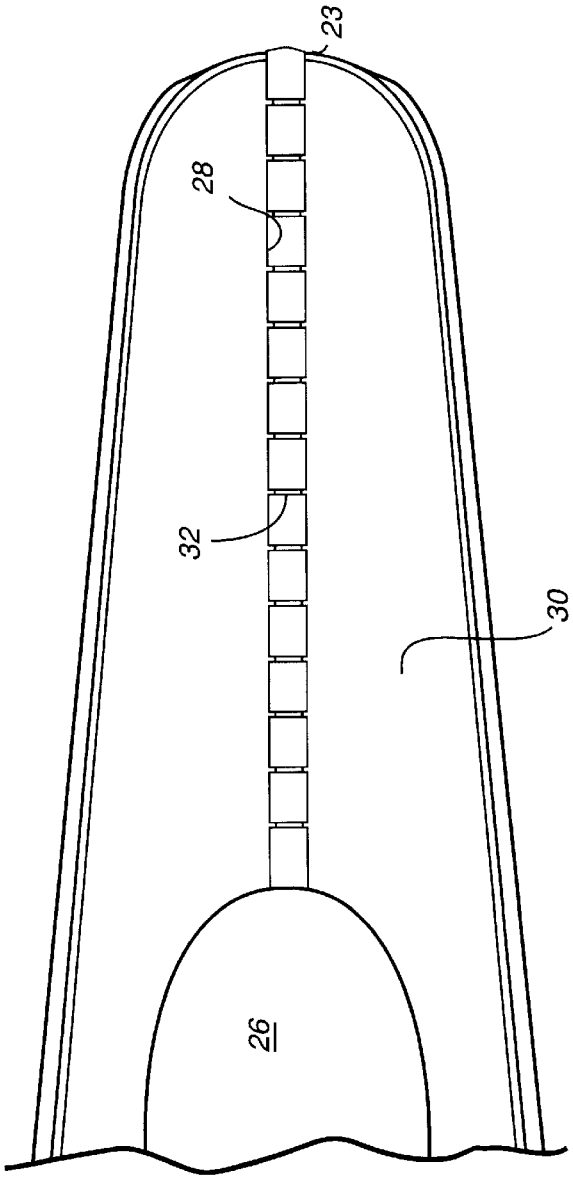
Fig. 2 Prior Art
FIG. 2 is an enlarged cross-sectional view through the trailing edge of a prior art nozzle vane illustrating a turbulated flow passage.

Referring to FIGS. 2 and 3, and as noted above, air-cooling of the trailing edges of nozzle vanes has been accomplished in the past. Typically, air is supplied into an aft cavity of each vane, for example, cavity 26, and a plurality of passages 28 spaced one from the other along the length of the vane are formed through the trailing edge 30 for flowing cooling air from the cavity 26 through passage openings spaced along the tip 23 of the trailing edge into the hot gas path. The passages 28 are typically provided with turbulators 32 spaced one from the other uniformly along the entire length of each passage 28. The turbulators 32 may take various forms and, in the illustrated prior art, take the form of a circumferentially extending ribs spaced axially and uniformly one from the other along the length of each passage 28. The turbulators provide turbulence to the flow of air and afford an increased cooling effect prior to exiting the trailing edge through the tip 23.

Figure 4:
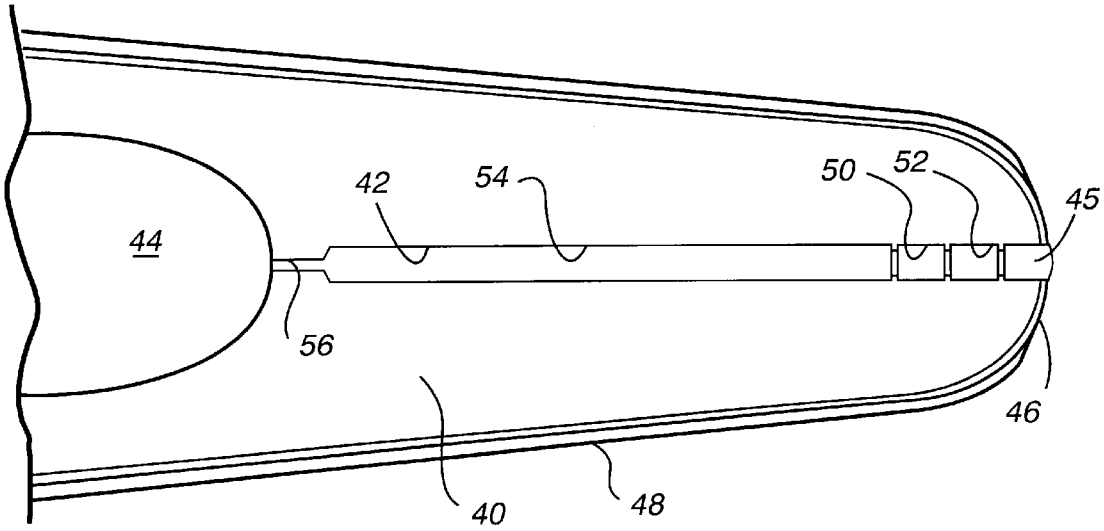
FIG. 4 is a cross-sectional view similar to FIG. 2 illustrating a partially turbulated trailing edge cooling passage for gas turbine nozzles according to the present invention.

In the present invention illustrated in FIG. 4, the trailing edge 40 of a nozzle vane, for example, the vane 22 of FIG. 1, has a plurality of passages 42 spaced one from the other along the length of the trailing edge. Each passage lies in communication with a cavity 44 supplied with cooling air, preferably compressor discharge air. The opposite ends of the passages 42 open through apertures 45 through the tip 46 of the trailing edge 40 for flowing the spent cooling air directly into the hot gas path. Also illustrated in FIG. 4 is a thermal barrier coating (TBC) 48 formed along the side faces of the trailing edge 40. The TBC coating is typically applied along the tip of the trailing edge but sometimes through handling or in actual operation, comes off or spalls off from the tip 46, leaving the tip region of the trailing edge 40 unprotected by the TBC. Consequently, it is important that the tip region of the trailing edge receives enhanced cooling. It is also important that the temperature distributions laterally across the trailing edge have reduced thermal gradients to minimize thermally induced stresses. To minimize the temperature gradients yet provide enhanced cooling at the tip region of the trailing edge, each of the cooling passages 42 is partially turbulated with the turbulators being located adjacent an aft portion 50 of the passage 42. As illustrated in FIG. 4, the turbulators comprise circumferentially extending ribs 52 which form abutment surfaces affording turbulence to the air passing through the aft passage portions 50, thereby providing enhanced cooling effects in the tip region of the trailing edge. It will be appreciated that the turbulators 52 may take other forms, such as pins, bars, roughened surfaces or the like. Preferably also, the passages 42 are circular in cross-sectional configuration. Cooling passages circular in cross-section, in contrast to other cross-sectional shapes such as oval, have been demonstrated to also provide enhanced cooling effects.

As illustrated in FIG. 4, the majority of the length of each passage 42 is non-turbulated, i.e., the major portion 54 of the passage 42 is preferably smooth bore. The TBC coating 48 as illustrated extends along the side faces of the trailing edge vane. Consequently, the temperature distribution or gradient laterally along the trailing edge is minimal whereby insubstantial thermal stresses are minimized.

It is also significant that by reducing the magnitude of the trailing edge regions requiring enhanced cooling effect, a reduction in the thermal medium, i.e., the compressor discharge bleed air for cooling purposes, can be effected. Thus, to limit the cooling air flow, each of the passages 42 has a forward end 56 which forms a flow restriction between the larger diameter forward smooth bore portion of the passage 42 and the cavity 44. A limited magnitude of cooling air thus enters the cooling passages from the cavity 44 thereby reducing the required magnitude of bleed air from the compressor. The restriction 56 may take any number of forms and, in the illustrated instance, comprises a smaller smooth bore opening affording the reduced cross-section of the inlets to the passages 42.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Cooling apparatus for a turbine comprising:

a turbine vane having a trailing edge terminating in an aft tip and a cavity forward of said trailing edge for receiving a thermal medium;

said trailing edge including a plurality of discrete passages spaced one from another along the length of the trailing edge, said passages lying in communication at one end with and directly opening into said cavity for receiving the thermal medium from said cavity for flow therethrough to apertures along said tip of said trailing edge; and turbulators disposed in said passages along aft portions thereof with portions of said passages forwardly of said aft portions and forming the majority of the lengths of said passages being without turbulators, each turbulator forming an abutment surface in said aft passage portion for creating turbulence in said thermal medium passing through said aft passage portions thereby cooling the trailing edge and minimizing thermal gradients and stresses therealong.

2. Apparatus according to claim 1 wherein said forward passage portions have smooth bores.

3. Apparatus according to claim 1 wherein said passages have circular cross-sections.

4. Apparatus according to claim 1 wherein said turbulators comprise a plurality of ribs projecting radially inwardly into said passages.

5. Apparatus according to claim 1 wherein said forward portions of said passages have reduced flow inlet apertures adjacent junctions of said cavity and said passages for limiting the flow of thermal medium into said passages.

6. Apparatus according to claim 1 wherein said turbulators are disposed solely along aft portions of said passages.

7. Apparatus according to claim 6 wherein said forward passage portions have smooth bores throughout their lengths.

* * * * *